US006517183B2

(12) United States Patent
Bruch et al.

(10) Patent No.: US 6,517,183 B2
(45) Date of Patent: Feb. 11, 2003

(54) METHOD FOR DETECTING DROPS IN PRINTER DEVICE

(75) Inventors: Xavier Bruch, Barcelona (ES); Xavier Girones, Tarragona (ES); Albert Serra, Barcelona (ES); Ramon Vega, Barcelona (ES); Antoni Murcia, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/105,830

(22) Filed: Mar. 25, 2002

(65) Prior Publication Data

US 2002/0140760 A1 Oct. 3, 2002

Related U.S. Application Data

(63) Continuation of application No. 09/502,667, filed on Feb. 11, 2000.

(51) Int. Cl.[7] ..... B41J 2/165
(52) U.S. Cl. ..... 347/19; 347/23
(58) Field of Search ..... 347/19, 23

(56) References Cited

U.S. PATENT DOCUMENTS 5,455,608 A * 10/1995 Stewart et al. ..... 347/23
6,224,183 B1 * 5/2001 Kono et al. ..... 347/19

FOREIGN PATENT DOCUMENTS

| | | |
|---|---|---|
| EP | 0622195 | 11/1994 |
| EP | 0744295 | 11/1996 |
| EP | 0767067 | 4/1997 |
| EP | 0794060 | 9/1997 |

* cited by examiner

*Primary Examiner*—Craig Hallacher

(57) ABSTRACT

An improved apparatus for checking a plurality of printer nozzles in a printer device comprises: a printer head comprising a plurality of nozzles; a device for detecting at least one droplet of ink sprayed from at least one nozzle of said plurality of nozzles; and a device for performing a sequence of measurements on a first output signal of the detecting device, wherein a determination of performance of the print head is made by analyzing detected output signals produced by one or a plurality of ink droplets passing the detector, the one or plurality of ink droplets containing a predetermined minimum volume of ink, and the sequence of measurements being measured at a plurality of time intervals.

54 Claims, 9 Drawing Sheets

METHOD FOR DETECTING DROPS IN PRINTER DEVICE

CROSS REFERENCE TO RELATED APPLICATION(S)

This is a continuation of copending application Ser. No. 09/502,667 filed on Feb. 11, 2000 which is hereby incorporated by reference herein.

FIELD OF THE INVENTION

The present invention relates to printer devices, and particularly although not exclusively to a method and apparatus for improving the detection of faulty or clogged nozzles in printer devices.

BACKGROUND TO THE INVENTION

It is known to produce paper copies, also known as "hard" copies, of files stored on a host device, e.g., a computer using a printer device. The print media onto which files may be printed includes paper and clear acetates for use in lectures, seminars and the like.

Referring to FIG. 1 herein, there is illustrated a conventional host device 100 in this case a personal computer, linked to a printer device 120 via a cable 110. Amongst the known methods for printing text and the like onto a print medium such as paper it is known to build up an image on the paper by spraying droplets of ink from a plurality of nozzles.

Referring to FIG. 2 herein, there is illustrated schematically part of a prior art printer device comprising an array of printer nozzles 220 arranged into parallel rows. The unit comprising the arrangement of printer nozzles is known herein as a printer head. In a conventional printer of the type described herein the printer head 210 is constrained to move in a direction 260 with respect to the print medium 200 e.g. a sheet of A4 paper. In addition, the print medium 200 is also constrained to move in a further direction 250. Preferably, direction 260 is orthogonal to direction 250. During a normal print operation, printer head 210 is moved into a first position with respect to the print medium 200 and a plurality of ink droplets are sprayed from a same plurality of printer nozzles 220 contained within printer head 210. This process is also known as a print operation. After the completion of a print operation the printer head 210 is moved in a direction 260 to a second position and another print operation is performed. In a like manner, the printer head is repeatedly moved in a direction 260 across the print medium 200 and a print operation performed after each such movement of the print head 210. When the printer head 210 reaches an edge of the print medium 200, the print medium is moved a short distance in a direction 250, parallel to a main length of the print medium 200, and another print operation is performed. The printer head 210 is then moved in a direction 260 back across the print medium 200 and another print operation is performed. In this manner, a complete printed page is produced.

In order to maintain the quality of the printed output of the printer device it is important that each instruction to the printer head to produce an ink drop from a nozzle of the plurality of nozzles does indeed produce such an fin drop. In conventional printers it is known to attempt to detect an ink drop as it leaves the nozzle during normal operation. In conventional printers this drop detection is used to indicate the end of life the printer head 210. Drop detection is known to be performed by a drop detection assembly 270. It is known to locate the drop detection assembly 270 outside of the region used for printing onto said print medium 200 and the drop detection assembly 270 is known to be located substantially close to an edge of said print medium 200.

Referring to FIG. 3 herein there is illustrated schematically a conventional drop detection system used in a production printer. An ink droplet 300 is sprayed from a nozzle 220 and the droplet subsequently follows the path 310. The path 310 traced by the ink droplet 300 is configured to pass between a light emitting diode (LED) 320 and a receiving photo diode 340. The light emitted by the light emitting diode 320 is collimated by a lens 330 to produce a narrow light beam which is detected by photo diode 340. In response to the light received, photo diode 340 produces a current which is amplified by amplifier 350. Conventionally, the supply of current and hence the brightness of the light emitted by LED 320 is configured so as to provide a constant current output from photo diode 340. For example, a decrease in the output current of photo diode 340 results in an increased current to LED 320. The resulting increase and brightness of LED 320 produces an increased output current of photo diode 340.

When an ink droplet 300, fired from nozzle 220, passes through the narrow light beam between LED 320, collimating lens 330 and photo diode 340 the ink droplet 300 partially blocks the light input into photo diode 340 as a result the output current of the photo diode decreases. The decrease in the output current of photo diode 340 is detected and, as described herein before, the input current into LED 320 is increased. However, due to the comparatively slow response time of the purgatory the increase in the input current into LED 320 produces an "over shoot" in the output current of photo diode 340. Hence, the amplified current reduced by the photo diode 340 in the presence of a ink droplet 300 is to produce a characteristic pulse shape 350. In a conventional printer, the characteristic current pulse 350 produced by the passage of the ink droplet 300 is detected and counted by a prior art drop detection unit 370. In a conventional printer, a drop detection process comprises sending a signal to printer head 220 to fire an ink droplet 300 and attempting to detect the resulting characteristic current pulse 350 which is counted using drop detection device 370. The steps of firing a droplet and counting that the resulting characteristic current pulse is repeated six times. If four characteristic pulses 350 are counted from the six attempts to spray an ink droplet 300 then, in a conventional system, the printer nozzle 220 is considered to be functioning correctly.

However, because of the need for three separate optical components to produce the collimated light beam in conventional drop protection systems there is a greater possibility for misalignment between the various components. Any misalignment between the LED 320, collimating lens 330 and photo diode 340 results in the width of the region in which an ink droplet 300 may be detected being reduced. In addition, because prior art drop detection systems require that a plurality of droplets are sprayed and detected individually this results in a comparatively long detection time for a nozzle and waste of ink.

U.S. Pat. No. 5,430,306 (Hewlett Packard) discloses an opto electronic test device for detecting the presence of thermal-inkjet ink drops from a print head. The device includes an illumination-source, a collimating aperture, a lens for focusing a collimated light beam on to a detector which converts varying illumination intensities into a varying output electrical signal. The output signal of the detector is converted to a digital signal by an aialogue-to-digital converter (A/D) and the digitized output is stored as a series of samples in a memory device. Drop detection is effected by triggering an ink droplet to be sprayed from a pen nozzle, and after a delay of approximately 100 μs, the droplet enters the collimated light beam. Occultation of the light input into the detector by the droplet causes a decrease in the output signal of the detector. The A/D converter samples the output signal of the detector and stores the sequence of digitized measurements in a memory. After a time delay, which is substantially longer than 100 μs, a second ink drop is triggered to be ejected from the pen nozzle and after a delay the output of the detector is again digitized. These measurements are repeated for a sequence of, typically, 8 ink droplets and an average time-profile of the output of the detector is formed by a micro-processor. A drop signal is determined to be present if, for example, the peak-to-peak voltage of the average signal is greater than a threshold value.

In order to average out noise fluctuations and derive a usable drop signal it is necessary to repeat the steps of ejecting a droplet and measuring an output signal of a detector as the droplet reverses up the light beam a number of times.

Since there is a significant delay, much longer than 100 μs, between each ink droplet ejected from the pen nozzle, the time required to test a printer head comprising a plurality of pen nozzles is significant.

The drop detector which is the subject of U.S. Pat. No. 5,430,306 is designed for use in a factory environment for testing the life of printer heads. The relative bulk of the strip light source, collimating apertures and focusing lens renders that invention unsuitable for implementation in individual production printer devices.

It is important, to improve the usability of production printers, to reduce the time required for characterizing a print head having a plurality of nozzles, as much as possible. However, the problem of characteristics becomes more difficult as the resolution of the printers becomes greater, as the droplet size reduces, because the signal to noise ratio of the drop detection signals reduces with reducing ink droplet size. In addition, it is important to develop more efficient use of printing ink.

SUMMARY OF THE INVENTION

The specific embodiments and methods according to the present invention aim to decrease the time required to test a printer device having a plurality of ink spray nozzles prior to printing, thereby increasing the number of tests performed on the nozzles yielding an improved knowledge of the functioning of the plurality of ink spray nozzles without affecting the printing rate of such devices and thereby improving printing quality and the functional lifetime of the plurality of ink spray nozzles.

Specific methods according to the present invention, recognize that by performing repeated measurements of an ink droplet near a drop detection device, the number of ink droplets that need to be sampled to provide an indication of a functioning printer nozzle may be reduced and hence the time taken to check the plurality of nozzles may be reduced.

According to a first aspect of the present invention there is provided an ink jet printer device characterized by comprising a printer head comprising a plurality of nozzles (400) for ejecting ink; means for detecting a sequence of droplets of ink ejected from said plurality of nozzles (540, 560) said detecting means operable to generate an output signal pulse in response to each ink droplet of said detected sequence of droplets of ink; and means for performing a measurement on each said output signal pulse of said detecting means (520), wherein for each said nozzle, said measurement means performs measurements on a number of output signal pulses corresponding to a number of detected ink droplets containing a predetermined volume of ink.

In the case of a nozzle ejecting black ink, the number of detected ink droplets per each said nozzle is preferably two. In the case of a nozzle ejecting ink of a color other than black, the number of detected ink droplets per each nozzle is preferably four. In each case, irrespective of the number of ink drops ejected, the nozzle is characterized on the basis of a predetermined volume of ink ejected from the nozzle. This predetermined volume can be ejected as one, two, four or another number of individual droplets.

Suitably, the means for performing measurements comprises a digital sampling means operable to produce a sequence of a plurality of digital sample signals, each quantized to represent an amplitude of a portion of said output signal pulse. The sampling means preferably performs a sequence of sampled measurements on a said output signal pulse at a sampling rate in the range 30 kHz to 50 kHz. A sampling period between samples in the range 12 s to 50 s has been found optimal, and in the best mode herein a sampling period of 40 s is applied. The detecting means is operable to output for each said detected ink droplet an analogue output signal pulse having an amplitude perturbation comprising a first portion of a lower amplitude than a steady state-amplitude output signal of 40 (s is applied. The detecting means is operable to output for each said detected ink droplet an analogue output signal pulse having- an amplitude perturbation comprising a first portion of a lower amplitude than a steady state amplitude output signal of 40 (s is applied. The detecting means is operable to output for each said detected ink droplet an analogue output signal pulse having an amplitude perturbation comprising a first portion of a lower amplitude than a steady state amplitude output signal of 40 (s is applied. The detecting means is operable to output for each said detected ink droplet an analogue output signal pulse having an among diode is an high intensity infra-red light emitting diode. The emitting element and receiving element are preferably located in the rigid locating means, which preferably comprising: a first housing (460); a second housing (450); and a rigid connecting member (470) being substantially straight and having a first end and a second end, wherein said first housing (460) is rigidly attached to said first end of said rigid connecting member and said second housing (450) is rigidly connected to said second end of said connecting member (470). Suitably the print head is aligned with the first and second housing elements such that ink droplets released from the print head follow a trajectory in which they pass between the emitter and detector mounted in the first and second housings respectively.

Preferably the first housing (460) has a first aperture (461); and said second housing (450) has a second aperture (451), wherein said first aperture (461) is located substantially opposite said second aperture (451), such that a beam of light may form a path between said first and second apertures.

In an optimal arrangement, said first housing means (460) houses said emitting element (540); and said second housing means (450) houses said receiving element (560), wherein said emitting element (540), said first aperture (461), said second aperture (451), and said receiving element (560) are configured to lie along a single substantially straight line.

Preferably the measuring means comprises: a processor; and a memory device (530), wherein said processor and said memory device are configured to operate for converting a said output signal into a plurality of integer number signals. The plurality of integer number signals are stored in the memory device. Preferably the measuring means is operable to measure said first output signal of said detecting means and convert said measured output signal into an integer number signal.

The invention includes an ink jet printer device configured to print onto a print medium, said printer device comprising: a printer head comprising a plurality of nozzles, said printer device characterized by further comprising; an elongate rigid connecting member having a first end and a second end; a first housing arranged for mounting an emitter device, said first housing rigidly attached to said first end of said elongate rigid connecting member; and a second housing arranged for mounting a detector device, said second housing attached rigidly to said second end of said elongate rigid connecting member, wherein said printer head is located with respect to said first housing and said second housing such that at least one ink droplet ejected from a nozzle of said plurality of nozzles of said printer head passes between said first housing and said second housing, in a trajectory which intersects a beam path between said emitter device and said detector device, said printer device further comprising means for measuring an output signal of said detector device, said measurement means operating to generate for a said nozzle a signal indicating a performance of said nozzle, in response to a said detector signal resulting from passage of said at least one ink droplet containing a predetermined volume of ink across said beam path.

According to a second aspect of the present invention there is provided a method for determining an operating characteristic of a nozzle of a print head of an ink jet printer device having an ink drop detection means, said nozzle being configured to eject a plurality of drops of ink said method characterized by comprising the steps of: sending an instruction to said print head to eject a predetermined sequence of at least one drop of ink from said nozzle said predetermined sequence of at least one drop containing a predetermined volume of ink; generating an output signal of said ink drop detecting means, said output signal generated in response to said pre-determined sequence of at least one ink drop; measuring said output signal of said ink drop detecting means; and determining said operating characteristic of said nozzle from said output signal.

Preferably said predetermined volume of ink lies in the range 30 picoliters to 100 picoliters.

As mentioned hereinabove, a said predetermined sequence, in the case of black ink suitably comprises two consecutively released ink drops, and for an ink color other than black, said predetermined sequence preferably comprises four consecutively released ink drops.

The step of measuring said output signal preferably comprises sampling said signal at a sample frequency in the range 30 kHz to 50 kHz. A sampling period between consecutive.samples is preferably in the range 12 s to 50 s, and optimally of the order 25 s.

Preferably the step of measuring said output signal of said ink droplet detection means comprises for each of said plurality of ink drops the steps of: waiting a fixed time period after said instruction is sent to said print head; performing a sequence of measurements on said output signal of said ink drop detecting means, wherein said sequence of measurements measure said output signal of said ink drop detection means at a plurality of time intervals.

Preferably said step of determining said operating characteristic comprises analyzing a sequence of at least one perturbation of said output signal produced in response to a predetermined volume of ink passing said detecting means.

Preferably the step of determining said operating characteristics of said nozzle comprises for each said ink drop, the steps of: identifying a largest value of output signal of said ink drop detecting means; identifying a smallest value of output signal of said ink drop detecting means; and subtracting said smallest value of output signal of said ink drop detecting means from said largest value of output signal level of said ink drop detecting means.

Preferably the step of determining an operating characteristic of a said nozzle comprises the steps of: determining a value of a perturbation of said output signal; and comparing said value of perturbation with a threshold value, wherein said threshold value is set at least six standard deviations above an average noise level of said output signal.

Preferably said total volume of said predetermined sequence of drop of ink passing said ink drop detecting means is configured to lie within a range of volumes which generates a said output signal having a peak to peak perturbation value of at least six standard deviations above a noise level of said output signal.

Suitably, the volume of said predetermined sequence of drops of ink lies substantially in a range 30 to 100 picolitres. The predetermined number of drops may be ejected from a said nozzle at a substantially constant ejection frequency.

According to a third aspect of the present invention there is provided a method for evaluating an operation of each nozzle of a print head comprising a plurality of nozzles, said nozzles being configured to eject a plurality of drops of ink, said method characterized by comprising the steps of:

a) sending an instruction to said print head to eject a pre-determined sequence of drops of ink from each said nozzle each said sequence of drops containing a predetermined volume of ink;
b) generating an output signal of an ink drop detecting means for each sequence of drops detected;
c) measuring said output signal of said ink drop detecting means for each sequence of drops detected;
d) determining an operating characteristic of a corresponding respective said nozzle from each said output signal.

Preferably said step of measuring said output signal of said ink droplet detecting means comprises the steps of: waiting a fixed time period after a said instruction is sent to said print head; and after said fixed time period has elapsed, performing a sequence of measurements on said output signal of said ink droplet detecting means to sample said output signal at a plurality of time intervals.

Preferably said step of determining an operating characteristic of said nozzle comprises for each signal corresponding to a said ink droplet ejected from said nozzle performing the steps of: identifying a largest value of output signal of said ink droplet detecting means; identifying a smallest value of output signal of said ink droplet detecting means; and subtracting said smallest value of output signal of said ink droplet detecting means from said largest value of output signal of said ink droplet detecting means, to obtain a peak to peak signal value representing a magnitude of perturbation resulting from a said ejected of ink droplet.

The method may comprise determining an operating characteristic of said print head from said plurality of nozzle operating characteristics.

According to a fourth aspect of the present invention there is provided a method of characterizing a print head of an inkjet printer comprising a plurality of nozzles capable of ejecting ink droplets, said method characterized by comprising the steps of:

selecting an individual nozzle of said plurality of nozzles;

generating a signal for instructing said nozzle to eject a predetermined sequence of at least one ink droplet;

continuously monitoring an analogue output signal of a detector device configured for detecting passage of said predetermined sequence of at least one droplet through a light beam;

digitizing said analogue output signal;

sampling said analogue output signal to produce a set of quantized digital samples of said output signal;

determining from said set of quantized samples a minimum level of said output signal;

determining from said quantized digitized samples a maximum level of said output signal;

determining a difference value between said maximum and said minimum levels;

comparing said difference value with a predetermined threshold level; and depending on a result of said difference value determining whether said nozzle is satisfactory.

If said determined peak to peak value is greater than said threshold value, said nozzle may be accepted as satisfactory. If the determined peak to peak value is less than said threshold value, said nozzle may rejected as unsatisfactory.

The analogue signal comprises at least one perturbation, resulting from passage of a said ink droplet through said light beam, and preferably said step of sampling said output signal comprises sampling a said perturbation resulting from said ink droplet at a period between samples in the range 12 s to 50 s. Suitably, sampling said analogue output signal may be sampled at a sampling frequency in the range 30 kHz to 50 kHz.

Suitably the threshold level is set at least six standard deviations above an average measured noise level of said output signal.

The method may be repeated in steps i) to x) until a number of nozzles recorded as unsatisfactory exceeds a predetermined number.

The method may be repeated in steps i) to x) for each of said plurality of nozzles.

The method may further comprise the step of activating a printer head intervention procedure in which one or a plurality of unsatisfactory nozzles are automatically attempted to be cleaned if said number of unsatisfactory nozzles exceeds a predetermined quantity.

The method may further comprise the step of activating a process in which during a print operation, one or more satisfactory nozzles are used to eject a predetermined sequence of ink droplets in replacement of using said at least one unsatisfactory nozzle if said recorded number of unsatisfactory nozzles exceeds a predetermined quantity.

A said predetermined quantity of unsatisfactory nozzles is suitably set in the range 6% to 12% of a total number of nozzles comprising said print head.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

Specific methods according to the present invention described herein are aimed at printer devices having a printer head comprising a plurality of nozzles, each nozzle of the plurality of nozzles being configured to spray a stream of droplets of ink. Printing to a print medium is performed by moving the printer head into mutually orthogonal directions in between print operations as described herein before. However, it will be understood by those skilled in the art that general methods disclosed and identified in the claims herein, are not limited to printer devices having a plurality of nozzles or printer devices with moving print heads.

Figure 1:
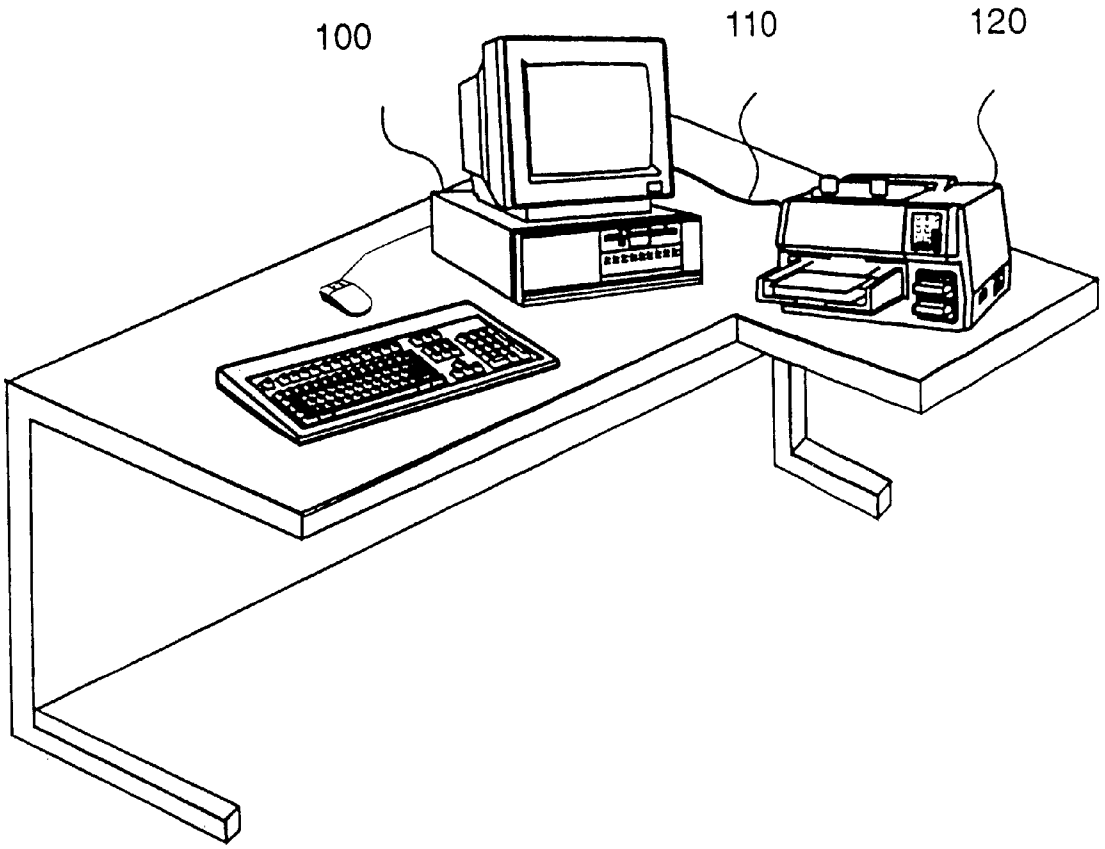
Fig. 1 (Prior Art)
Figure 2:
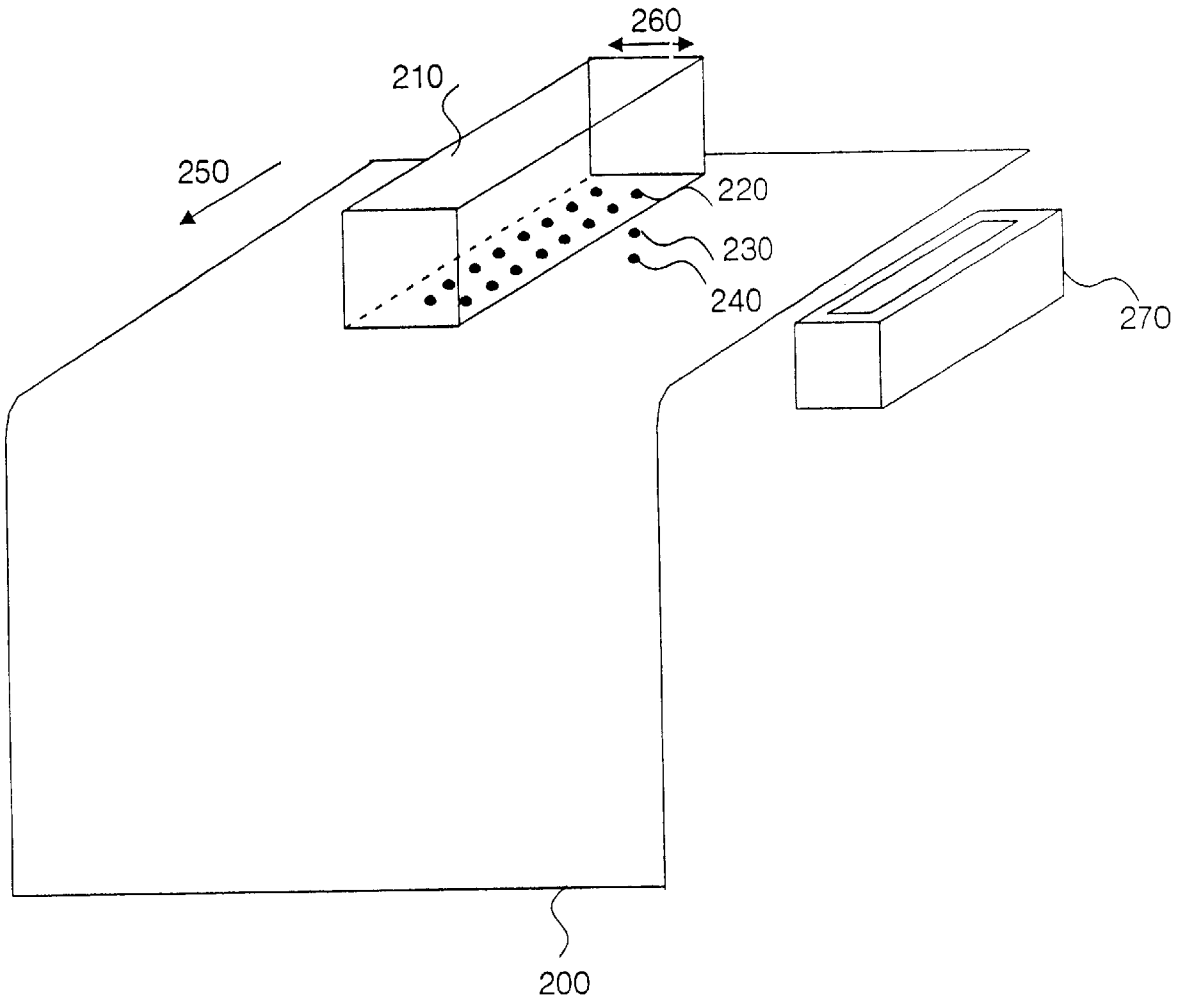
Fig. 2 (Prior Art)
Figure 3:
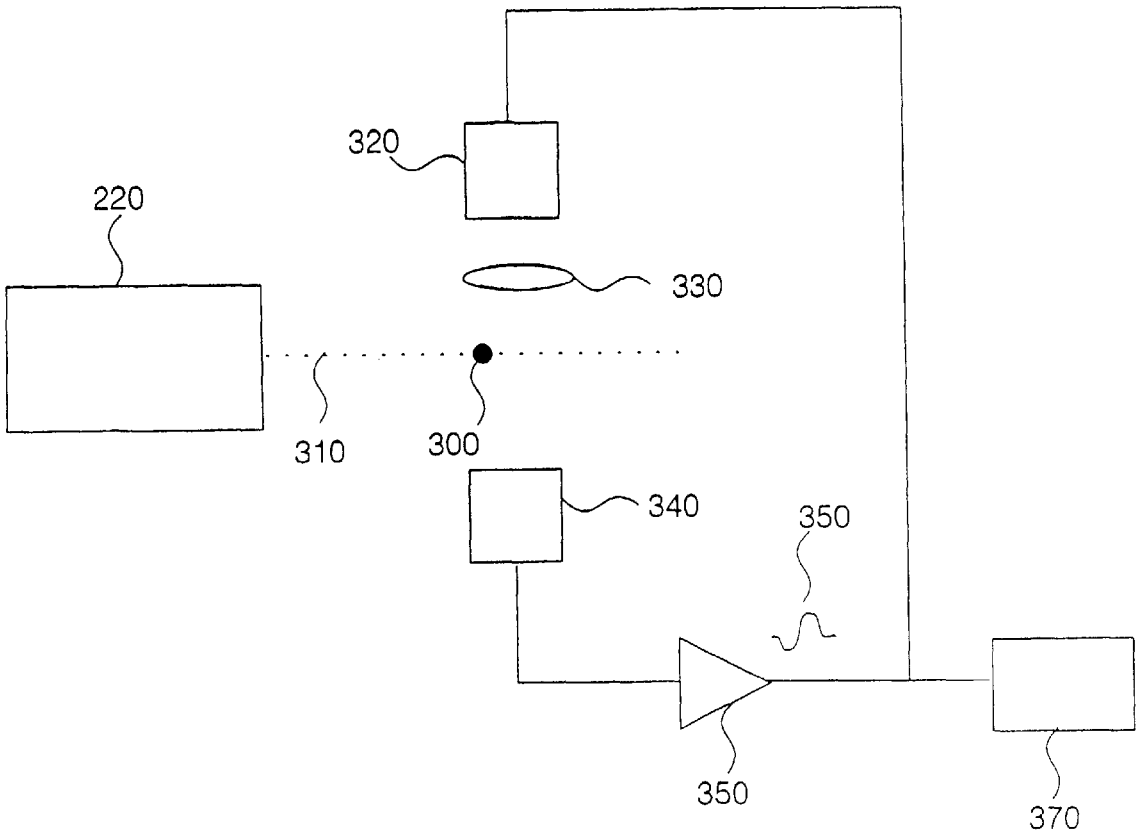
Fig. 3 (Prior Art)
Figure 4:
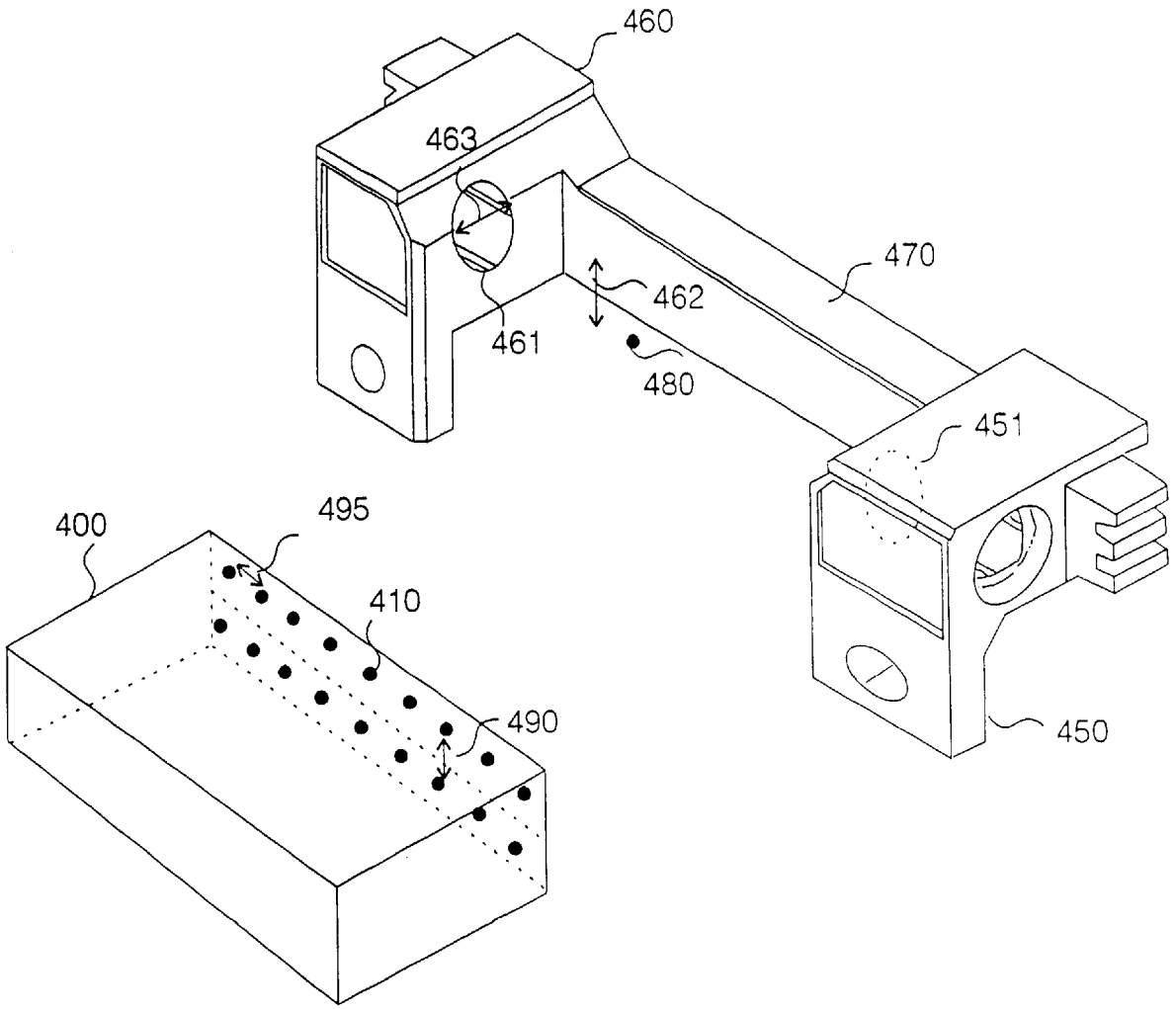
FIG. 4 illustrates an improved drop detection device according to a specific implementation of the present invention.

Referring to FIG. 4 herein, there is illustrated schematically a printer head and improved drop detection device according to specific embodiments of the present invention. A printer head 400 comprises an assembly of printer nozzles 410. Preferably, the printer head 400 is comprised of two rows of printer nozzles 410, each row containing 524 printer nozzles. According to a specific method of the present invention, the printer nozzles in a first row are designated by odd numbers and the printer nozzles in a second row are designated by even numbers. Preferably, a distance 490 between corresponding nozzles of the first and second rows is of the order 4 millimeters and a distance between adjacent printer nozzles 495 within a same row is 1/600 inches yielding a printed resolution of 600 dots per inch.

The printer head 400 is configured, upon receiving an instruction from the printer, to spray or eject a single droplet of ink 480 from single nozzle of the plurality of nozzles.

Each nozzle 410 of the plurality of nozzles comprising printer head 400 are, according to the best mode presented herein, configurable to release a sequence of ink droplets in response to an instruction from the printer device. In addition to the printer head 400, there is also included an ink droplet detection means comprising a housing 460 containing an high intensity infra-red light emitting diode; a detector housing 450 containing a photo diode detector and a elongate, substantially straight rigid member 470. The emitter housing 460, bar 470 and detector housing 450 all comprise a rigid locating means configured to actively locate the high intensity infra-red light emitting diode with respect to the photo diode detector.

The printer head 400 and the rigid locating means 460, 470 and 450 are orientated with respect to each other such that a path traced by an ink droplet 480 sprayed from a nozzle of the plurality of nozzles comprising the printer head 400 passes between emitter housing 460 and detector housing 450.

The high intensity infra-red light emitting diode contained within emitter housing 460 is encapsulated within a transparent plastics material casing. The transparent plastics material casing is configured so as to collimate the light emitted by the light emitting diode into a light beam. According to the best mode described herein, the collimated light beam emitted by the high intensity infra-red LED contained within emitter housing 460 exits the emitter housing via aperture 461. The collimated light beam from emitter housing 460 is admitted into detector housing 450 by way of aperture 451. The light beam admitted into detector housing 450 illuminates the photo diode detector contained within detector housing 450. An ink droplet 480 sprayed from a nozzle 410 entering the collimated light beam extending between apertures 461 and 451 causes a decrease in the amount of light entering aperture 451 and hence striking the photo diode contained with detector housing 450. Ink droplets are only detected if they pass through an effective detection zone in the collimated light beam which has a narrower width than a width of the collimated light beam. Preferably, the width of the effective detection zone 462 is 2 millimeters. A width 463 of the emitter housing aperture 461 and a same width of the detector housing aperture 451 are preferably 1.7 millimeters.

Figure 5:
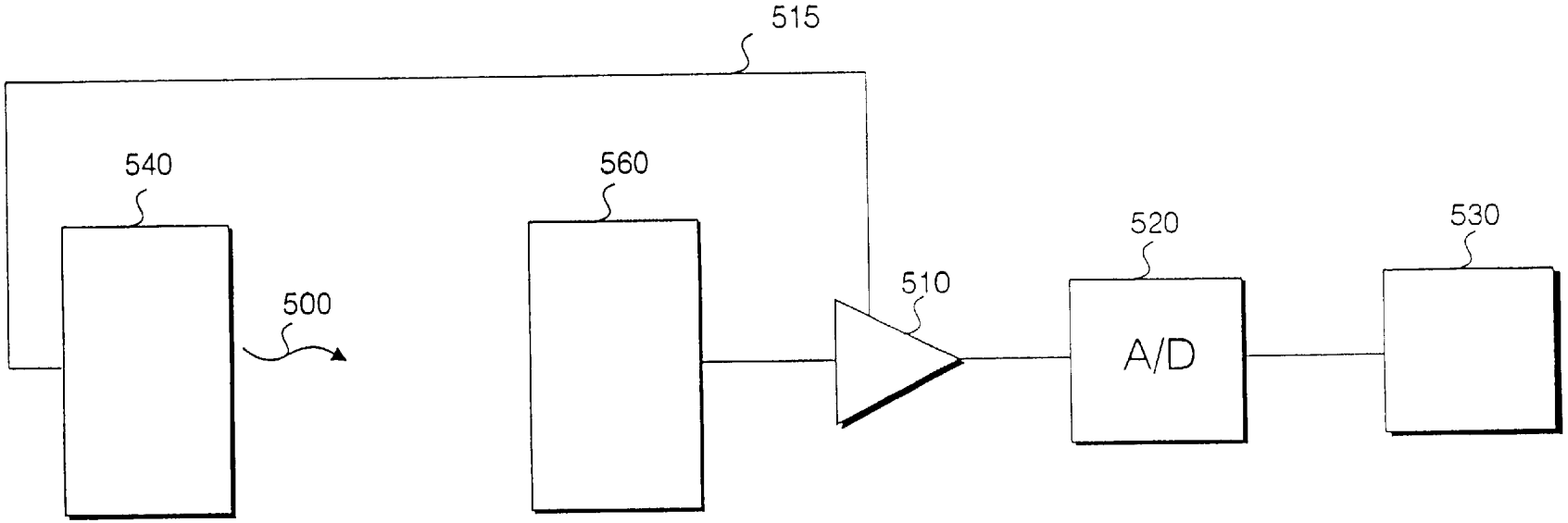
FIG. 5 illustrates schematically an overview of the functional blocks of the improved drop detection according to a specific method of the present invention.

Referring to FIG. 5 herein, there is illustrated schematically the functional blocks comprising the improved drop detection according to the best mode presented herein. High intensity infra-red LED 540 emits light 500 which is absorbed by photo diode detector 560. The output current of the photo diode detector 560 is amplified by amplifier 510. Additionally, amplifier 510 is configured to increase a driver current to high intensity infra-red LED 540 in response to a decrease in an output current of the photo diode detector 560 and to decrease an input current into high intensity infra-red LED 540 in response to an increase in the output current of photo diode detector 560 via signal path 515. An amplified output current of amplifier 510 is then input into an analogue to digital (A/D) converter 520. The A/D converter 520 samples the amplified output of the photo diode. Preferably, the A/D converter 520 samples the amplified output current 64 times with a sampling frequency of 40 kilohertz. The period between samples is, preferably, 25 $\mu$s yielding a total sampling time of 1.6 milliseconds. The 64 samples of the output of the photo diode 560 are stored within a memory device in drop detection unit 530.

According to the best mode presented herein, drop detection unit 530 processes the sampled output current of the photo diode detector 560 to determine whether or not an ink droplet has crossed the collimated light beam between the high intensity infra-red LED 540 and the photo diode detector 560.

Analysis of the output current of the photodiode detector 560 enables operating characteristics of the printer nozzles to be determined.

Drop detection unit 530 may also be configured to store in a memory device an indication of whether or not a nozzle of the plurality of nozzles comprising printer head 400 is "good" of "bad".

According to the best mode presented herein, before printing a page the printer device checks the nozzles comprising printer head 400 by performing a sequence of operations which are known hereinafter as drop detection. Each nozzle within a row of nozzles in turn sprays a pre-determined sequence of ink droplets such that only one nozzle is spraying ink droplets at any time. Each nozzle within the plurality of nozzles comprising the printer head are uniquely identified by a number. Preferably, a first row of nozzles are identified by a contiguous series of odd numbers between 1 and 523 and a second row of nozzles are identified by a contiguous series of even numbers between 2 and 524. During drop detection the odd numbered nozzles within a row each sprays a pre-determined sequence of ink droplets and then the printer head 400 is moved to bring the second row of nozzles in line with the effective detection zone 462. Each even numbered nozzle, in turn, sprays a same pre-determined sequence of ink droplets.

In order to maximize the signal output of the photo diode detector the pre-determined sequence of ink droplets are timed such that all of the ink droplets within the pre-determined sequence are within the collimated light beam at substantially the same moment. In order to produce a signal at the output of the photo diode detector 560 which is distinguishable from the background noise there is a minimum volume of ink which must be simultaneously occulting the collimated light beam. Preferably, the total volume of the ink droplets simultaneously located within the collimated light beam is in the range 30 to 100 pl. Hence, in a monotone pen of a printer which produces an ink droplet having a volume of 35 pl the pre-determined sequence comprises 2 ink droplets separated by a period of 83 $\mu$s. The operation of spraying a pre-determined sequence of ink droplets is also known as "spitting". The time duration of 83 $\mu$s corresponds to a spitting frequency of 12 kilohertz. The spitting frequency is also known herein as an ejection frequency. In printer devices configured to produce color prints, each ink droplet has a volume of 11 picolitres and hence the number of droplets required lie simultaneously within the collimated light beam is for yielding a total ink droplet volume in the light beam of 44 picolitres. Preferably, the spitting frequency for ink droplets in printer devices configured to produce color prints is 12 kilohertz. It will be understood by those skilled in the art that a general method disclosed herein may be applied to printer devices having different ink droplet volumes and spitting frequencies.

Figure 6:
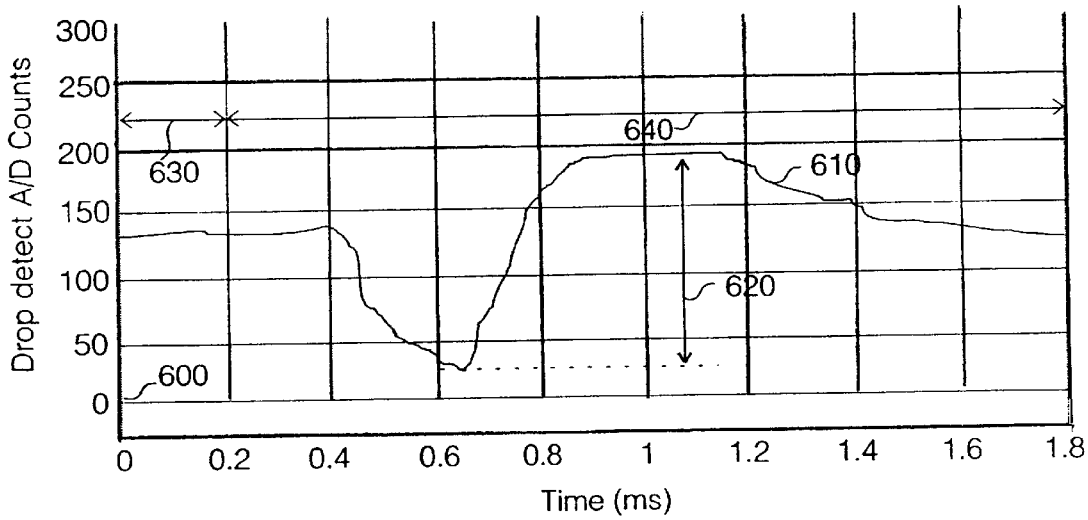
FIG. 6 illustrates, by way of example, an output signal of a drop detection device according to a specific implementation of the present invention prior to analogue to digital conversion.

Referring to FIG. 6 herein there is illustrated graphically, by way of example, an output of A/D converter 520 illustrating a signal 610 produced by a single droplet of the pre-determined sequence of ink droplets crossing the collimated light beam between the high intensity infra-red LED 540 and the photo diode 560. Referring to FIG. 6, at time 0 milliseconds (ms) a first droplet of a pre-determined sequence of droplets is sprayed from a nozzle. After a delay of 0.2 ms to allow the droplets to travel from the nozzle to the collimated light beam. The A/D converter 520 commences sampling the amplified output of the photo diode detector 560. The time delay of 0.2 ms is also known as fly time. From approximately 0.4 to 0.6 ms the output of the photo diode detector 560 lo drops as the pre-determined sequence of ink droplets block light entering the photo diode. At approximately 0.65 ms the sampled output of the photo diode detector 560 increases in response to an increased input current into high intensity infra-red LED 540 as a result of a decreased output current of photo diode detector 560 as described herein before. The analogue output signal of amplifier 510 is sampled periodically at a sampling frequency in the range 30 kHz to 50 kHz, and preferably at 40 kHz by the analogue to digital convertor 520. Drop detection unit 530 inputs a stream of 64 digital samples of variable amplitude representing the pulse signal 510 resulting from the passage of the ink drop past the detector. Quantization of the amplitude element of the pulse signal may be implemented in A/D convertor 520, or in drop detector 530, to produce a measure of amplitude of each sample of the 64 samples of the single pulse signal resulting from the ink drop. The peak-to-peak signal 620 corresponds to a difference between a highest number of counts sampled and a lowest number of counts sampled, where a count is a quantization unit of current or voltage of the detector output signal. Preferably, the A/D convertor 520 quantizes the current or voltage of the detector output signal into an 8-bit digital signal. Hence, according to the best mode presented herein, the current or voltage of the detector output signal may be represented by a maximum of 256 counts.

A nozzle is determined to be functioning correctly if, after spraying from the nozzle one or a plurality of ink droplets in a pre-determined sequence, the peak-to-peak signal level resulting from one or a plurality of ink droplets is greater than a threshold value. It is important to choose a threshold level which lies outside the range of the natural variability of the measured peak-to-peak amplitude variation of the detector output 620 and which also lies outside the range of the variability in the noise introduced into the system by, for example, the photo diode 560 and amplifier 510.

Figure 7:
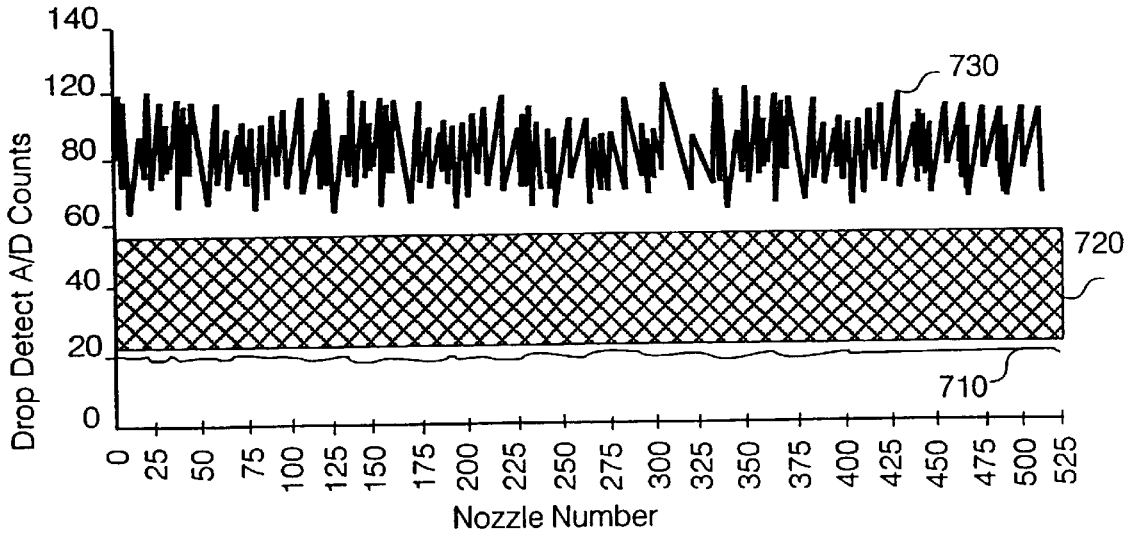
FIG. 7 illustrates graphically a region which falls within the drop detection reliability specification (hatched region); the drop detection peak to peak signal (thick line); and the noise peak to peak signal (thin line) according to a specific implementation of the present invention.

Referring to FIG. 7 herein, there is illustrated graphically typical A/D counts for peak-to-peak signals 730 for the plurality of nozzles comprising a printer head, an average noise level for noise introduced by the photo diode, etc. 710 and a hatched region 720 representing the range of threshold values which could be used in the drop detection algorithm. The plotted line 730 represents for each nozzle a peak to peak amplitude of one or more signals corresponding to one or more ink droplets ejected from the nozzle. In an optimum implementation, an objective is to obtain a reliable peak to peak reading from a single signal pulse, generated by passage of a single ink droplet ejected from a nozzle, so that a reliable print head test can be obtained from just one ink droplet per nozzle being ejected. Thus, in the example nozzle characteristic of FIG. 7, ideally the plotted line 730 of the peak to peak signals for a 525 nozzle print head would be produced by 525 ink droplets (one per nozzle) and 525 corresponding pulse signals 610, each sampled into 64 quantized samples. However, the signal to noise ratio of the detected signal for a single droplet depends upon the volume of the ink droplet. The larger the ink droplet, the better the signal to noise ratio. To achieve improved reliability at the expense of speed of testing, the print head characteristic 730 may be produced by, for each nozzle, averaging the peak to peak signal of a plurality of pulses produced by a corresponding plurality of droplets ejected from the nozzle. In the best mode herein, two pulses per print nozzle are ejected in a test sequence, so for a 525 nozzle print head, the print head characteristic 730 is produced by analyzing 1050 ink droplets each of volume 35 picoliters. Alternatively, reducing the droplet volume to 11 picoliters, 4 ink droplets per nozzle need to be ejected and detected to determine an average peak to peak pulse response signal for each nozzle. Thus, for 11 picoliter droplets, for a 525 nozzle array, 2100 individual ink droplets are ejected in a test sequence, 4 per nozzle, to provide a print head characteristic 730, which is sufficiently separated from the background noise, in which the peak to peak signal for each nozzle is determined from a plurality of signal pulses produced by a plurality of ink droplets ejected from the nozzle.

Preferably, the threshold value of the peak-to-peak number of counts used to determine whether a nozzle is functioning correctly or not is 45 A/D counts. This threshold value is established by using the following constraints:

1. The probability of incorrectly detecting a good drop from the noise level is less than 0.001 parts per million. To achieve this specification the threshold level should preferably be set at least six standard deviations above the average noise level. This yields a minimum threshold level of approximately 25 A/D counts.

The probability of incorrectly missing a correctly functioning nozzle is less than one part per million. In order to achieve this specification the threshold level must lie below the mean peak-to-peak signal level by five standard deviations. This yields a maximum threshold level of approximately 55 A/D counts.

Hence, the choice of threshold level of 45 A/D counts lies approximately mid-way between a maximum and a minimum threshold level, where said maximum and minimum values are calculated assuming that both the noise level and peak-to-peak counts are normally distributed.

Referring to Table 1 there are summarized important parameters according to the best mode described herein.

TABLE 1

| Drop Detect Algorithm Parameter | Value |
|---|---|
| Number of drops fired per nozzle | 2 × 35 pl/4 × 11 pl |
| Spitting frequency | 12 kHz |
| Signal Sampling frequency | 40 kHz |
| Total number of samples | 64 |
| Fly time | 0.2 ms |
| Detection threshold | 45 A/D |

Figure 8:
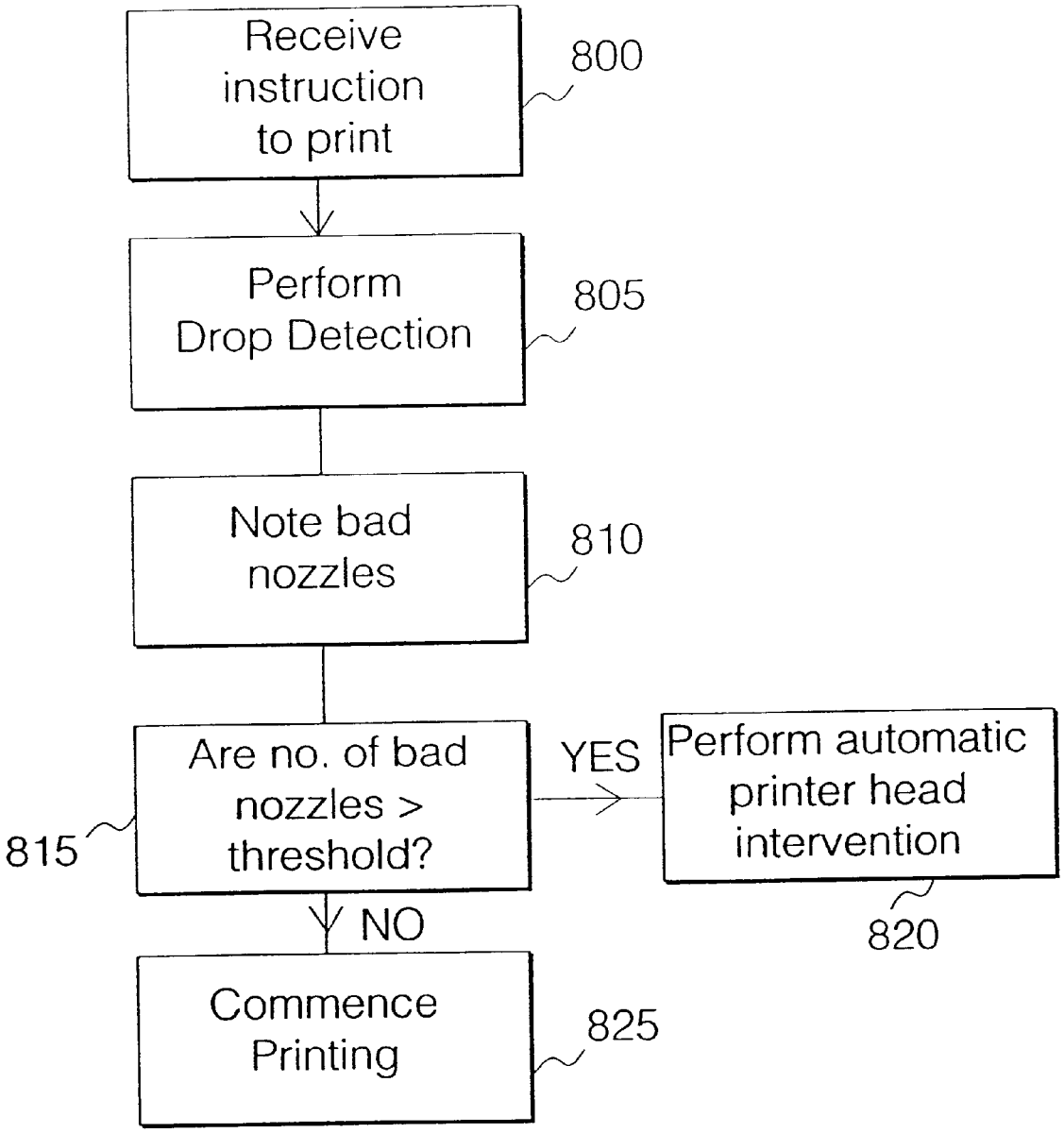
FIG. 8 illustrates schematically generalized process steps involved in drop detection performed before printing a page according to a specific method of the present invention.

Referring to FIG. 8 herein there is illustrated schematically a block diagram of the steps that occur when a printer device receives an instruction signals to print according to the best mode described herein. It will be appreciated that the print head is controlled by a series of signals generated by a print head driver device. The print head driver device comprises a processor and associated memory, operating in accordance with a set of algorithms. The algorithms may be implemented either as hardware operating in accordance with programmed instructions stored in memory locations, or as firmware in which the algorithms may be explicitly designed into a physical layout of physical components. The process steps are described herein in a manner which is independent of their particular physical implementation, and the physical implementation of such process steps will be understood by those skilled in the art. In step 800, the printer device receives an instruction to print a page. In step 805, the printer performs a drop detection procedure which comprises spraying a pre-determined sequence of ink droplets from each nozzle in turn when attempting detect the sprayed ink droplets. In step 810, the identifying numbers of nozzles which are found not to function correctly during drop detection which are also known as "bad" nozzles are stored in a memory device. In step 815, if the number of bad nozzles is greater than a threshold number then in step 820 the printer device performs an automatic printer head intervention. Performing automatic printer head intervention 820 may comprise increased cleaning of the bad nozzles in an attempt to recover them. In addition, step 820 may further comprise steps generating error hiding information by which, during a print operation, good nozzles are re-used to spray a predetermined sequence of ink droplets in the place of non-functioning nozzles thereby improving print quality. If, in step 815, the number of bad nozzles is less than a same threshold number then, in step 825, the printer device commences printing. Preferably, said step of performing automatic printer head intervention 820 is initiated if, during a last fixed number of drop detections, the number of bad nozzles was greater than the threshold level. Preferably, the fixed number of previous drop detections may be 8, 16 or 64.

Figure 9:
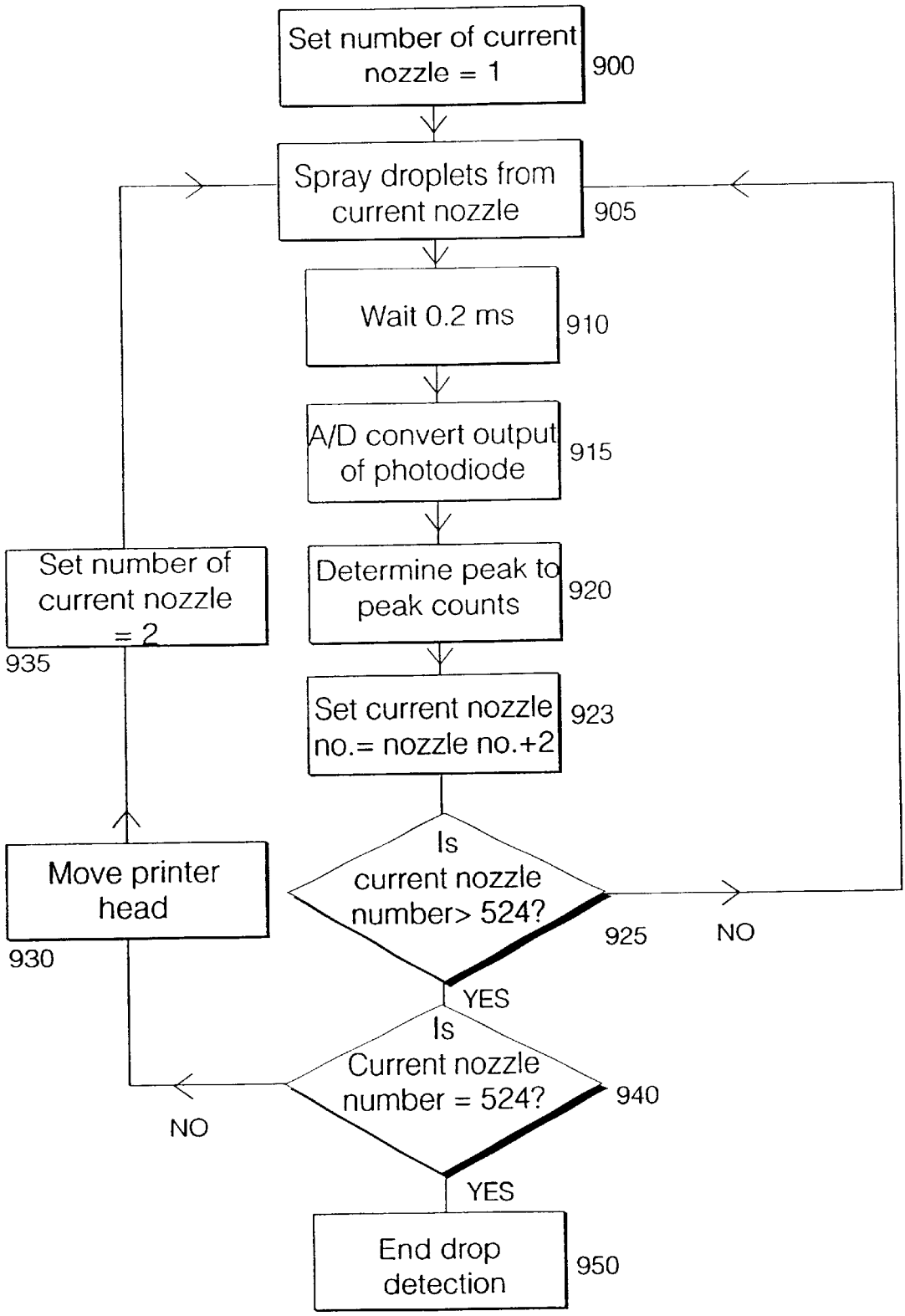
FIG. 9 illustrates schematically in more detail steps involved in drop detection according to a specific method of the present invention.

Referring to FIG. 9 herein, there is illustrated schematically a block diagram of the steps comprising drop detection step 805. In step 900, a number identifying a current nozzle of the plurality of nozzles of the printer head to be tested using drop detection is set to equal 1. In step 905 the current nozzle is instructed to spray a pre-determined sequence of droplets. Preferably, as described herein before, for a printer configurable to produce monotone output the predetermined sequence comprises two droplets separated in time by a period of 83 $\mu$s. Preferably, where the printer device is configurable to produce color output the predetermined sequence comprises four droplets spaced apart by a same duration of time of 83 $\mu$s. In step 910, there is a delay of 0.2 milliseconds which commences from substantially the same moment of time that a first droplet of the pre-determined sequence of droplets leaves the current nozzle. This delay enables the droplets to enter the infra-red light beam extending between emitter housing 460 and receiver housing 450 before measuring the output of the photo diode detector 560. This delay time is also known as "fly" time. In step 915 the A/D converter 520 measures an amplified output of photo diode detector 560. Preferably, the A/D converter 520 samples the amplified output of the photo diode detector 560 64 times with a same time duration of 25 $\mu$s between each measurement. This corresponds to a signal sampling frequency of 40 kilohertz. In step 920, the samples are processed using an algorithm to determine the peak-to-peak counts, which are used to discriminate between detection and non-detection of ink droplets sprayed from the current nozzle. Each nozzle receives a drive signal causing the nozzle to release a number of ink droplets corresponding to a predetermined volume of ink, preferably in the range 30 to 100 picoliters. The volume of ink is selected such that either a single ink droplet of at least the predetermined volume produces a detector signal having sufficient signal to noise ratio to reliably determine detection of the drop, and/or such that a series of two or more droplets having a combined volume which is at least the predetermined volume result in a series of detected signal pulses which when analyzed together, have a signal to noise ratio sufficient to reliably determine satisfactory operation of the nozzle. It has been found experimentally as described hereinabove in this specification, that in the best mode a predetermined volume of around 70 picoliters divided into two consecutively released droplets is optimum for characterizing a nozzle releasing black ink, and a predetermined volume of around 44 picoliters contained as 4 consecutively released droplets is optimum for characterizing a nozzle releasing colored ink, of a color other than black. In step 923, the number identifying the current nozzle is incremented by 2. By this means, the nozzle number 1, 3, 5, . . . , 523 comprising the first row are tested for correct functionality according to the best mode presented herein. In step 925, if the number identifying the current nozzle is less than 524 then steps 905 to 925 are repeated for the next nozzle. In step 940, if the number identifying the current nozzle is 524 then the perform drop detection step 805 is completed. Otherwise, in step 930, the printer head 400 is moved so as to ensure that droplets sprayed from the second row of even numbered nozzles passes through the effective detection zone of the infra-red light beam. In step 935, the number identifying the current nozzle is set equal to 2 and steps 905 to 925 are repeated for the even numbered nozzles comprising the second row of the printer head.

Figure 10:
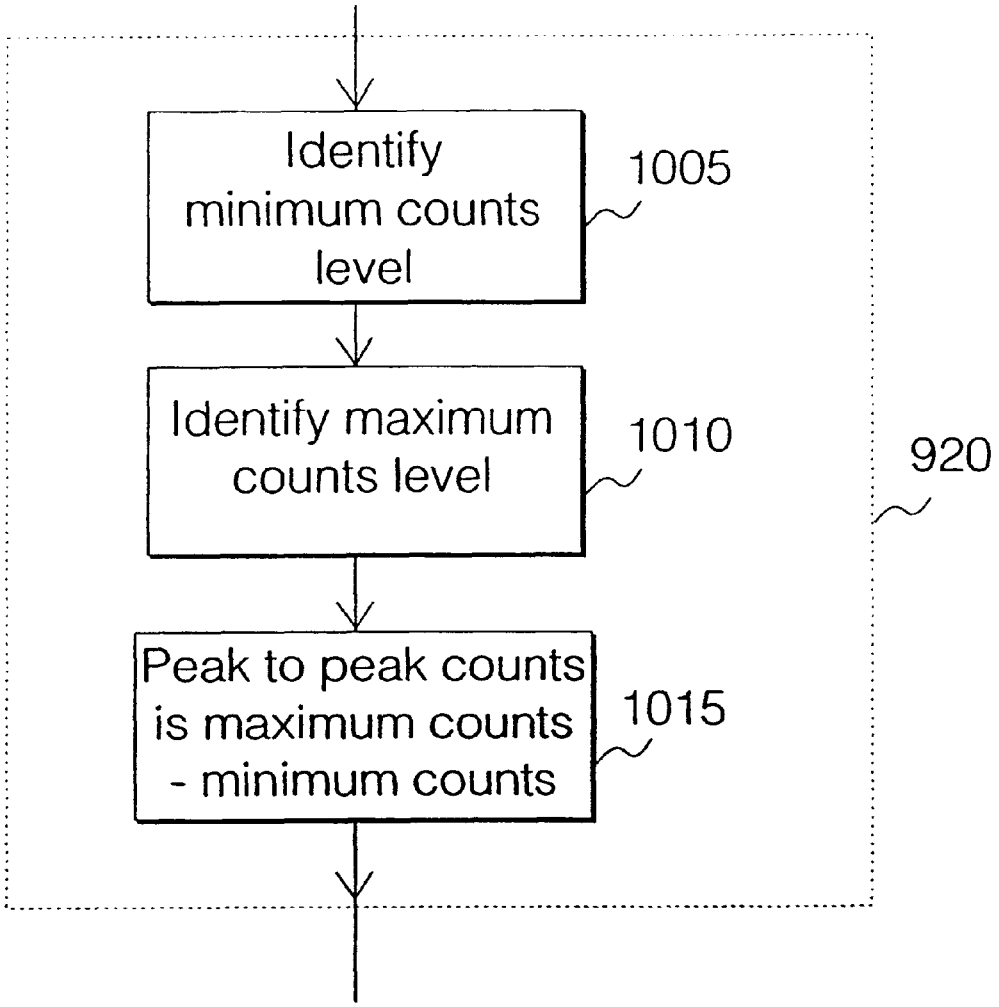
FIG. 10 illustrates schematically in more detail further steps involved in drop detection according to a specific method of the present invention.

Referring to FIG. 10 herein, there is illustrated schematically a flow diagram showing in more detail the steps involved in step 920 of FIG. 9. In step 1005, a minimum count level sampled by the A/D converter 520 sampling the output of photo diode 560 is identified. In step 1010, a maximum count level corresponding to the peak output from the photo diode detector 560 is identified. In step 1015, the peak-to-peak counts are calculated by forming a difference between the maximum count level and the minimum count level. In the best mode herein, this processing is performed by an Application Specific Integrated Circuit (ASIC) operating instructions stored in a read only memory.

Referring to Table 2 herein there are summarized the minimum detection times required to check the 524 nozzles comprising a printer head. The total time required to check pen comprising 524 nozzles within a printer device configured to print monotone plots is of the order 2 seconds. Approximately 1 second is required to move the nozzles into position with respect to the drop detect unit and a further period of approximately 1 second is required to perform drop detection on the 524 nozzles. Similarly, the time required for the improved drop detection method and apparatus to test the 1572 nozzles corresponding to 3 color pens within a printer device configured to produce color plots is of the order 4 seconds. This represents a significant improvement over prior art drop detection methods where, typically, 25 seconds was required to assess 600 nozzles.

TABLE 2

| Drop Detect Throughput | Seconds |
|---|---|
| Monotone Plots (1 pen) | 2 |
| Color Plots (3 pens) | 4 |

Reducing the time required to test the individual nozzles of a plurality of nozzles comprising a printer head and reduces the total time required to test a printer head. A decrease in the time required to test a printer head also corresponds to an increase in drop detect throughput. Increased drop detect throughput results in the following improvements:

It is possible to perform an increased number of tests of each nozzle of the plurality of nozzles without substantially effecting the total time required to print a page;

Increasing the number of tests on each nozzle improves reliability of the printer head since this yields a more up to date knowledge of the state of the printer heads;

More accurate knowledge of the misfunctioning nozzles improves the operation of error hiding print modes performed by the printer device. Error hiding print modes operate by deactivating a misfunctioning nozzle and reusing a functioning nozzle to print in its place during a print operation; and Increased tests on the functioning of nozzles enables more accurate functioning of a set of servicing algorithms via the printer device. The servicing algorithms are sets of instructions performed before printing a page, during printing and after a page has been printed and are designed to maintain correct operation of the nozzles comprising the printer head. Improved servicing of the nozzles results in an increased operating lifetime of the printer head.

What is claimed is:

1. An ink jet printer device comprising:

a printer head comprising a plurality of nozzles for ejecting ink;

means for detecting a sequence of droplets of ink ejected from said plurality of nozzles said detecting means operable to generate an output signal pulse in response to each ink droplet of said detected sequence of droplets of ink; and means for performing a measurement on each said output signal pulse of said detecting means, wherein for each said nozzle, said measurement means performs measurements on a number of output signal pulses corresponding to a number of detected ink droplets containing a predetermined volume of ink.

2. A printer device as claimed in claim 1, wherein said number of detected ink droplets per each nozzle is two.

3. A printer device as claimed in claim 1, wherein said number of detected ink droplets per each nozzle is four.

4. A printer device as claimed in claim 1, wherein said means for performing measurements comprises a digital sampling means operable to produce a sequence of a plurality of digital sample signals, each quantized to represent an amplitude of a portion of said output signal pulse.

5. A printer device as claimed in claim 1, wherein said measurement means comprises a digital sampling means operable to perform a sequence of sampled measurements on a said output signal pulse at a sampling rate in the range of about 30 kHz to 50 kHz.

6. A printer device as claimed in claim 1, wherein said measurement means comprises a digital sampling means operable to sample said detected output signal pulse with a sampling period between samples in the range of about 12 ms to 50 ms.

7. A printer device as claimed in claim 1, wherein said detecting means is operable to output for each detected ink droplet an analogue output signal pulse having an amplitude perturbation having a first portion of a lower amplitude than a steady state amplitude output signal of said detecting means, and a second amplitude portion of a higher amplitude than said steady state amplitude output signal.

8. A printer device as claimed in claim 1, wherein said means for detecting said predetermined sequence of droplets of ink ejected from said at least one nozzle of said plurality of nozzles comprises:

an emitting element configured to emit a light signal;

a receiving element configured to receive said light signal; and a means for rigidly locating said emitting element with respect to said receiving element.

9. A printer device as claimed in claim 8, wherein said emitting element comprises:

a light emitting diode; and a transparent plastics material casing, said casing being configured to focus a light output from said light emitting diode into a beam.

10. A printer device as claimed in claim 9, wherein said light emitting diode is an high intensity infra-red light emitting diode.

11. A printer device as claimed in claim 1, having a rigid locating means comprising:

a first housing;

a second housing; and a rigid connecting member being substantially straight and having a first end and a second end, wherein said first housing is rigidly attached to said first end of said rigid connecting member and said second housing is rigidly connected to said second end of said connecting member.

12. A printer device as claimed in claim 11, wherein:

said first housing has a first aperture; and said second housing has a second aperture, wherein said first aperture is located substantially opposite said second aperture, such that a beam of light may form a path between said first and second apertures.

13. A printer device as claimed in claim 11, wherein:

said first housing means houses an emitting element; and said second housing means houses a receiving element, wherein said emitting element, said first aperture, said second aperture, and said receiving element are configured to lie along a single substantially straight line.

14. A printer device as claimed in claim 1, wherein said measuring means comprises:

a processor; and a memory device, wherein said processor and said memory device are configured to operate for converting said output signal into a plurality of integer number signals.

15. A printer device as claimed in claim 14, wherein said memory device is configured to store said integer number signals.

16. A printer device as claimed in claim 1, wherein said measuring means is operable to measure an output signal of a detecting means and convert said measured output signal into an integer number signal.

17. An ink jet printer device configured to print onto a print medium comprising:

a printer head having a plurality of nozzles;

an elongate rigid connecting member having a first end and a second end;

a first housing arranged for mounting an emitter device, said first housing rigidly attached to said first end of said elongate rigid connecting member;

a second housing arranged for mounting a detector device, said second housing attached rigidly to said second end of said elongate rigid connecting member, wherein said printer head is located with respect to said first housing and said second housing such that at least one ink droplet ejected from a nozzle of said plurality of nozzles of said printer head passes between said first housing and said second housing, in a trajectory which intersects a beam path between said emitter device and said detector device; and means for measuring an output signal of said detector device, said measurement means operating to generate for said nozzle a signal indicating a performance of said nozzle, in response to said detector signal resulting from passage of said at least one ink droplet containing a predetermined volume of ink across said beam path.

18. A method for determining an operating characteristic of a nozzle of a print head of an ink jet printer device having an ink drop detection means, said nozzle being configured to eject a plurality of drops of ink, said method comprising:

sending an instruction to said print head to eject a predetermined sequence of at least one drop of ink from said nozzle said predetermined sequence of at least one drop containing a predetermined volume of ink;

generating an output signal of said ink drop detecting means, said output signal generated in response to said pre-determined sequence of at least one ink drop;

measuring said output signal of said ink drop detecting means; and determining said operating characteristic of said nozzle from said output signal.

19. The method as claimed in claim 18, wherein said predetermined volume of ink lies in the range of about 30 picoliters to 100 picoliters.

20. The method as claimed in claim 18, wherein said predetermined sequence comprises two consecutively released ink drops when said nozzle is releasing black ink.

21. The method as claimed in claim 18, wherein said predetermined sequence comprises four consecutively released ink drops when said nozzle is releasing an ink of a color other than black.

22. The method as claimed in claim 18, wherein measuring said output signal comprises sampling said signal at a sample frequency in the range of about 30 kHz to 50 kHz.

23. The method as claimed in claim 18, wherein sampling said output signal comprises performing sampling with a period between samples in the range of about 12 ms to 50 ms.

24. The method as claimed in claim 18, wherein measuring said output signal of said ink droplet detection means comprises:

waiting a fixed time period after said instruction is sent to said print head; and performing a sequence of measurements on said output signal of said ink drop detecting means, wherein said sequence of measurements measure said output signal of said ink drop detection means at a plurality of time intervals.

25. The method as claimed in claim 18, wherein determining said operating characteristic comprises analyzing a sequence of at least one perturbation of said output signal produced in response to a predetermined volume of ink passing said detecting means.

26. The method as claimed in claim 18, wherein determining said operating characteristic of said nozzle comprises:

identifying a largest value of output signal of said ink drop detecting means;

identifying a smallest value of output signal of said ink drop detecting means; and subtracting said smallest value of output signal of said ink drop detecting means from said largest value of output signal level of said ink drop detecting means.

27. A method as claimed in claim 18, wherein determining said operating characteristic of said nozzle comprises:

determining a value of a perturbation of said output signal; and comparing said value of perturbation with a threshold value, wherein said threshold value is set at least six standard deviations above an average noise level of said output signal.

28. The method as claimed in claim 18, wherein said total volume of said predetermined sequence of drop of ink passing said ink drop detecting means is configured to lie within a range of volumes which generates a said output signal having a peak to peak perturbation value of at least six standard deviations above a noise level of said output signal.

29. A method as claimed in claim 28, wherein said total volume of said predetermined sequence of drops of ink lie substantially in a range of about 30 to 100 picolitres.

30. A method as claimed in claim 18, wherein a predetermined number of drops are ejected from a said nozzle at a substantially constant ejection frequency.

31. A method for evaluating an operation of each nozzle of a print head comprising a plurality of nozzles, said nozzles being configured to eject a plurality of drops of ink, said method comprising:

sending an instruction to said print head to eject a predetermined sequence of drops of ink from each nozzle wherein each sequence of drops contains a predetermined volume of ink;

generating an output signal of an ink drop detecting means for each sequence of drops detected;

measuring said output signal of said ink drop detecting means for each sequence of drops detected; and determining an operating characteristic of a corresponding respective nozzle from each output signal.

32. The method as claimed in claim 31, wherein measuring said output signal of said ink droplet detecting means comprises:

waiting a fixed time period after a said instruction is sent to said print head; and after said fixed time period has elapsed, performing a sequence of measurements on said output signal of said ink droplet detecting means to sample said output signal at a plurality of time intervals.

33. The method is claimed in claim 31 wherein determining an operating characteristic of said nozzle comprises for each output signal for each sequence of drops detected:

identifying a largest value of output signal of said ink droplet detecting means;

identifying a smallest value of output signal of said ink droplet detecting means; and subtracting said smallest value of output signal of said ink droplet detecting means from said largest value of output signal of said ink droplet detecting means, to obtain a peak to peak signal value representing a magnitude of perturbation resulting from a said ejected of ink droplet.

34. The method as claimed in claim 31, further comprising determining an operating characteristic of said print head from said plurality of nozzle operating characteristics.

35. A method of characterizing a print head of an inkjet printer having a plurality of nozzles capable of ejecting ink droplets, said method comprising:

selecting an individual nozzle of said plurality of nozzles;

generating a signal for instructing said nozzle to eject a predetermined sequence of at least one ink droplet;

continuously monitoring an analogue output signal of a detector device configured for detecting passage of said predetermined sequence of at least one droplet through a light beam;

digitizing said analogue output signal;

sampling said analogue output signal to produce a set of quantized digital samples of said output signal;

determining from said set of quantized samples a minimum level of said output signal;

determining from said quantized digitized samples a maximum level of said output signal;

determining a difference value between said maximum and said minimum levels;

comparing said difference value with a predetermined threshold level; and depending on a result of said difference value determining whether said nozzle is satisfactory.

36. The method as claimed in claim 35, wherein if said determined difference value is greater than said threshold value, said nozzle is accepted as satisfactory.

37. The method as claimed in claim 35, wherein sampling said analogue output signal comprises sampling at a sampling frequency in the range of about 30 kHz to 50 kHz.

38. The method as claimed in claim 35, wherein said analogue signal includes at least one perturbation, resulting from passage of said ink droplet through said light beam, and sampling said output signal comprises sampling said perturbation resulting from said ink droplet at a period between samples in the range of about 12 ms to 50 ms.

39. The method as claimed in claim 35, wherein if said determined difference value is less than said threshold value, said nozzle is rejected as unsatisfactory.

40. The method as claimed in claim 35, wherein said threshold level is set at least six standard deviations above an average measured noise level of said output signal.

41. The method as claimed in claim 35, further comprising:

repeating the method until a number of nozzles recorded as unsatisfactory exceeds a predetermined number.

42. The method as claimed in claim 35, further comprising:

repeating the method for each of said plurality of nozzles.

43. The method as claimed in claim 41, further comprising activating a printer head intervention procedure in which one or a plurality of unsatisfactory nozzles are automatically attempted to be cleaned if said number of unsatisfactory nozzles exceeds a predetermined quantity.

44. The method as claimed in claim 41, further comprising activating a process in which during a print operation, one or more satisfactory nozzles are used to eject a predetermined sequence of ink droplets in replacement of using said at least one unsatisfactory nozzle if said recorded number of unsatisfactory nozzles exceeds a predetermined quantity.

45. The method as claimed in claim 42, wherein said predetermined quantity of unsatisfactory nozzles is set in the range of about 6% to 12% of a total number of nozzles of said print head.

46. An ink jet printer device comprising:

a printer head comprising a plurality of nozzles for ejecting ink;

a sensor for detecting a sequence of droplets of ink ejected from said plurality of nozzles, said sensor operable to generate an output signal pulse in response to each ink droplet of said detected sequence of droplets of ink; and a sampling device for performing a measurement on each said output signal pulse of said sensor, wherein for each said nozzle, said sampling device performs measurements on a number of output signal pulses corresponding to a number of detected ink droplets containing a predetermined volume of ink.

47. A printer device as claimed in claim 46, wherein said number of detected ink droplets per each nozzle is two.

48. A printer device as claimed in claim 46, wherein said number of detected ink droplets per each nozzle is four.

49. A printer device as claimed in claim 46, wherein said sampling device comprises a digital sampling device operable to sample said detected output signal pulse with a sampling period between samples in the range of about 12 ms to 50 ms.

50. A printer device as claimed in claim 46, wherein said sensor is operable to output for each detected ink droplet an analogue output signal pulse having an amplitude perturbation having a first portion of a lower amplitude than a steady state amplitude output signal of said sensor, and a second amplitude portion of a higher amplitude than said steady state amplitude output signal.

51. A printer device as claimed in claim 46, wherein said sampling device comprises:

a processor; and a memory device, wherein said processor and said memory device are configured to operate for converting said output signal into a plurality of integer number signals.

52. An ink jet printer device configured to print onto a print medium comprising:

a printer head having a plurality of nozzles;

an elongate rigid connecting member having a first end and a second end;

a first housing arranged for mounting an emitter, said first housing rigidly attached to said first end of said elongate rigid connecting member;

a second housing arranged for mounting a sensor, said second housing attached rigidly to said second end of said elongate rigid connecting member, wherein said printer head is located with respect to said first housing and said second housing such that at least one ink droplet ejected from a nozzle of said plurality of nozzles of said printer head passes between said first housing and said second housing, in a trajectory which intersects a beam path between said emitter and said sensor; and a sampling device for measuring an output signal of said sensor, said sampling device operating to generate for said nozzle a signal indicating a performance of said nozzle, in response to said sensor signal resulting from passage of said at least one ink droplet containing a predetermined volume of ink across said beam path.

53. A method for determining an operating characteristic of a nozzle of a print head of an ink jet printer device having an ink drop sensor, said nozzle being configured to eject a plurality of drops of ink, said method comprising:

sending an instruction to said print head to eject a predetermined sequence of at least one drop of ink from said nozzle, said predetermined sequence of at least one drop containing a predetermined volume of ink;

generating an output signal of said ink drop sensor, said output signal generated in response to said predetermined sequence of at least one ink drop;

measuring said output signal of said ink drop sensor; and determining said operating characteristic of said nozzle from said output signal.

54. The method as claimed in claim 53, wherein measuring said output signal of said ink drop sensor comprises:

waiting a fixed time period after said instruction is sent to said print head; and performing a sequence of measurements on said output signal of said ink drop sensor, wherein said sequence of measurements measure said output signal of said ink drop sensor at a plurality of time intervals.

* * * * *